US008365497B2

(12) United States Patent
Rothwell

(10) Patent No.: US 8,365,497 B2
(45) Date of Patent: Feb. 5, 2013

(54) INSULATED PANEL

(76) Inventor: Jordan Byron Rothwell, Burlington (CA)

( * ) Notice: Subject to any disclaimer, the term of this patent is extended or adjusted under 35 U.S.C. 154(b) by 283 days.

(21) Appl. No.: 12/543,747

(22) Filed: Aug. 19, 2009

(65) Prior Publication Data

US 2010/0043327 A1 Feb. 25, 2010

Related U.S. Application Data

(60) Provisional application No. 61/089,971, filed on Aug. 19, 2008.

(51) Int. Cl.
*E04C 1/00* (2006.01)
*E04B 1/74* (2006.01)

(52) U.S. Cl. ..... 52/742.12; 52/742.13; 52/309.4; 52/344; 52/404.1; 156/71

(58) Field of Classification Search ..... 52/309.4, 52/309.5, 344, 349, 354, 404.1, 407.3, 408, 52/742.1, 742.12, 742.13, 745.05, 309.8, 52/794.1, 742.11; 428/71, 306.6, 316.6; 264/46.5; 156/71, 78, 79, 293
See application file for complete search history.

(56) References Cited

U.S. PATENT DOCUMENTS

| | | | | | |
|---|---|---|---|---|---|
| 3,785,913 | A * | 1/1974 | Hallamore | 428/71 |
| 3,796,593 | A * | 3/1974 | Finelli | 427/393.5 |
| 3,879,908 | A * | 4/1975 | Weismann | 52/309.5 |
| 3,991,252 | A * | 11/1976 | Kolakowski et al. | 52/309.9 |
| 4,259,028 | A * | 3/1981 | Cook | 405/282 |
| 4,471,591 | A | 9/1984 | Jamison | |
| 5,192,598 | A * | 3/1993 | Forte et al. | 428/71 |
| 5,389,167 | A * | 2/1995 | Sperber | 156/71 |
| 5,787,665 | A * | 8/1998 | Carlin et al. | 52/309.4 |
| 6,026,629 | A * | 2/2000 | Strickland et al. | 52/794.1 |
| 6,099,768 | A * | 8/2000 | Strickland et al. | 264/46.4 |
| 6,119,422 | A * | 9/2000 | Clear et al. | 52/309.8 |
| 6,322,869 | B1 * | 11/2001 | Dietrich | 428/69 |
| 6,415,580 | B2 * | 7/2002 | Ojala | 52/794.1 |
| 6,584,749 | B2 * | 7/2003 | Sperber | 52/742.1 |
| 6,727,290 | B2 * | 4/2004 | Roth | 521/54 |
| 7,168,216 | B2 | 1/2007 | Hagen, Jr. | |
| 7,574,837 | B2 * | 8/2009 | Hagen et al. | 52/404.1 |
| 2008/0127600 | A1 * | 6/2008 | Schiffmann et al. | 52/741.1 |
| 2011/0036030 | A1 * | 2/2011 | Hegland | 52/309.4 |
| 2011/0138724 | A1 * | 6/2011 | Olang | 52/309.4 |

FOREIGN PATENT DOCUMENTS

| | | | |
|---|---|---|---|
| CA | 2097788 | | 5/1997 |
| DE | 4315533 | A1 * | 12/1994 |
| FR | 2589905 | A1 * | 5/1987 |
| FR | 2722811 | A1 * | 1/1996 |
| JP | 2000234402 | A * | 8/2000 |
| JP | 2002188242 | A * | 7/2002 |

OTHER PUBLICATIONS

Translation of FR 2589905.*
Translation of DE 4315533.*
International Preliminary Report on Patentability for PCT/CA2009/001151 mailed on Mar. 3, 2011.
PCT Search Report for PCT Application No. PCT/CA2009/001151, Sep. 29, 2009.

* cited by examiner

*Primary Examiner* — Robert Canfield
*Assistant Examiner* — Brent W Herring
(74) *Attorney, Agent, or Firm* — Carlson, Gaskey & Olds, P.C.

(57) ABSTRACT

The insulated panel comprises exterior sheathing, studs, rigid foam panels and a spray-pour foam. The rigid foam panels are placed up against the sheathing between the studs, and the spray-pour foam is used to fill in the voids.

7 Claims, 5 Drawing Sheets

INSULATED PANEL

This application claims priority to U.S. Provisional Application Ser. No. 61/089,971, filed Aug. 19, 2008.

BACKGROUND OF THE INVENTION

The present invention provides a panel with improved insulating characteristics and an improved method for making an insulated panel.

Various methods have been used to produce foam filled wood stud walls. One particular method, developed by the Assignee of the present invention, is particularly suited to prefabricated walls and is described in U.S. Pat. No. 5,273,693. In that method, a half completed stud wall is introduced into an apparatus comprising a backplate and a moveable dam having a removable sheet and a compressible membrane. The exterior sheathing of the stud wall is placed against the backplate. The stud wall is backed with any suitable exterior sheathing, such as asphalt-impregnated fiber board. The removable sheet is draped over the interior of the stud wall. The compressible membrane is placed over the removable sheet and the moveable dam urges the backplate, stud wall, removable sheet and compressible membrane together. The compressible membrane forms a seal between the dam and the studs and is urged into the wall cavity reducing the volume of the cavity.

A foam or foam-forming mixture is introduced between the sheathing and the moveable dam having the removable sheet and the compressible membrane, which is temporarily positioned against the interior side of the studs. The foam or foam-forming mixture is introduced by a "spray-pour" method. In this type of method, a spray-type urethane foam is injected between the exterior sheathing and the dam using an atomizing spray nozzle having a tube to direct the trajectory of the spray. The foam is then permitted to rise freely between the sheathing and the dam and is allowed to set.

After allowing sufficient setting time to elapse, the dam is moved to the next upper unfilled section of the stud wall while the removable sheet and the compressible membrane are unrolled in advance of the moveable dam and the next bath of foam or foam-forming mixture is introduced into the wall. The wall can therefore be filled in a series of spray-pours.

This method produced a foam insulated wall panel with excellent thermal performance and a uniform planar finish on the interior surface. However, the application of urethane foam is a highly exothermic process and during the curing phase these panels are sometimes subject to some distortion.

SUMMARY OF THE INVENTION

In one embodiment, the insulated panel comprises exterior sheathing, studs, rigid foam panels and spray/pour foam that is cured in place. The rigid foam panels are placed up against the sheathing between the studs, and the spray/pour foam is used to fill in the void.

In another embodiment, the rigid foam panels have beveled sides and second rigid foam panels are placed over the rigid foam panels. The rigid foam panels are placed up against the sheathing between the studs, with the second rigid foam panels placed up against the rigid foam panels. The spray/pour foam is used to fill in the void between the rigid foam panels. The beveled sides of the rigid foam panels aid in placing the rigid foam panels, prevent the spray/pour foam from penetrating and expanding behind the rigid foam panels and pushing them outwards and help in allowing the rigid foam panels to be fitted around electrical boxes and other such elements.

In another embodiment, the rigid foam panels are without beveled sides, but instead are placed by guides or spacers, and held in place by the adhesive. The spray/pour foam is used to fill in the void between the rigid foam panels and the sheathing. Lack of beveled sides ease manufacturing of the rigid foam panels and allow the rigid foam panels to be cut to fit a cavity, while still allowing the rigid foam panels to be fitted around electrical boxes and other such elements.

DETAILED DESCRIPTION OF THE PREFERRED EMBODIMENT

Figure 1:
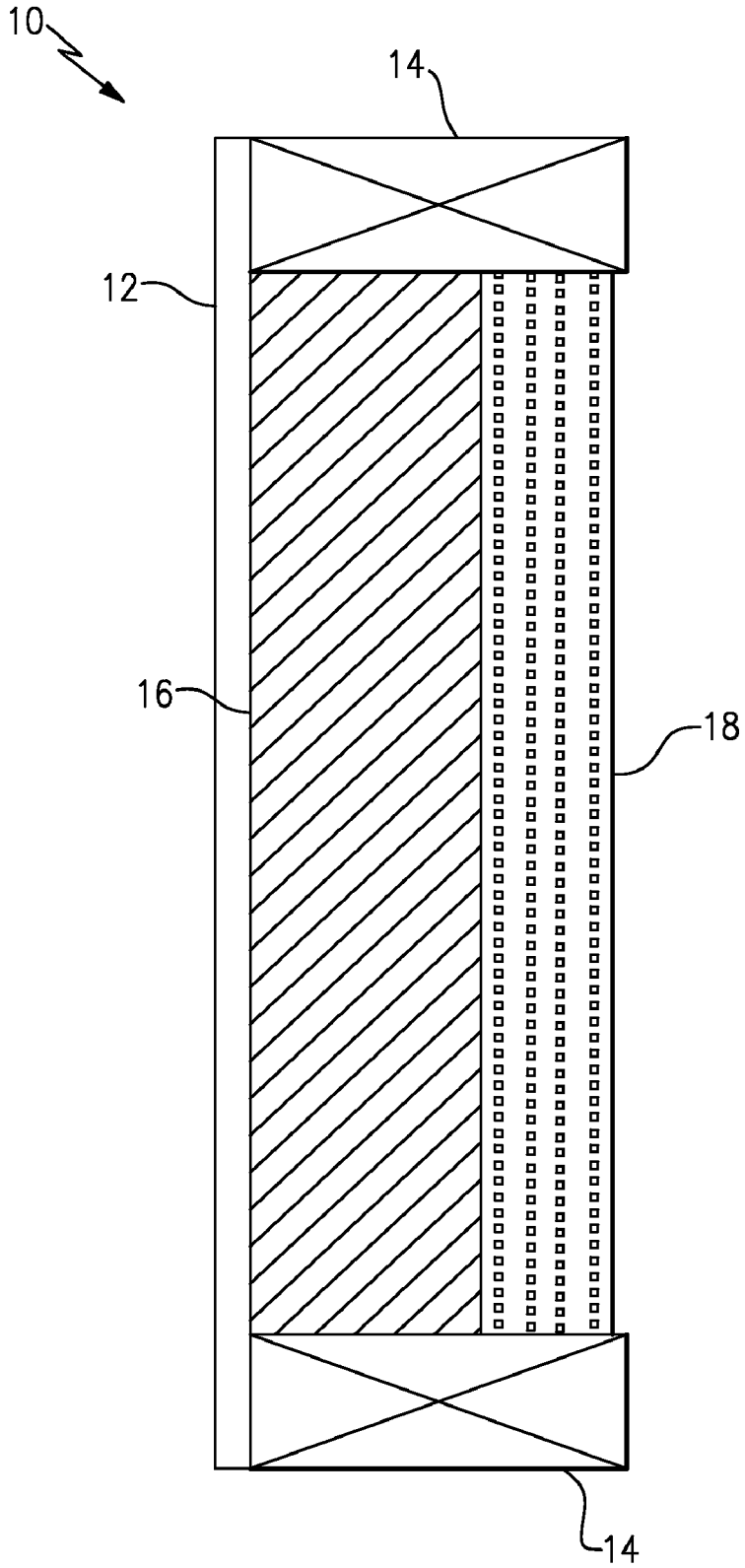
FIG. 1 illustrates a cavity cell of a first example insulated panel of the present invention in a top view cross section.

FIG. 1 is a top view cross section through a cavity cell of a prefabricated insulated panel 10 according to one embodiment of the present invention. Generally, the panel 10 includes exterior sheathing 12 secured to a plurality of studs 14 such as by nails, screws, adhesives, etc. The studs 14 may be 2×4, 2×6, 2×3 or other dimensions. The panel 10 could be a portion of a wall, roof, floor or other building structure.

Between the studs 14, rigid foam panels 16 are secured to the exterior sheathing 12 and/or the studs 14. Preferably, the rigid foam panels 16 occupy more than half the width of the studs 14. For example, for nominal 2×4 studs 14, the rigid foam panels 16 could be at least two inches thick. The rigid foam panel 16 may be Expanded Polystyrene (EPS) or extruded polystyrene; however other materials may be used.

The remaining space between the studs 14 is then filled with uncured spray-pour foam 18 such as spray-pour polyurethane foam. The uncured foam is then cured in place. For example, the remainder of the void can be filled with the spray-pour foam 18 in a series of spray-pours, as performed in the previous method described above and as described in more detail U.S. Pat. No. 5,273,693, which is hereby incorporated by reference in its entirety. Other methods for filling the void with foam could also be used. Note that the foam 18 is not filled all the way to the inner edge of the studs 14. The rigid foam panels 16 may be restrained or pressed against the sheathing 12 while the spray-pour foam 18 is filled and until it is at least substantially cured.

With this technique, the panel 10 is easier to manufacture and is less subject to distortion caused by the curing of the foam. The rigid foam panels 16 displace sufficient foam 18 to eliminate distortion on the sheathing 12, while the layer of spray-pour foam 18 still provides an air-tight seal between the studs 14. This technique allows the mixing of different foam types in the spray-pour foam 18 to achieve different thermal resistance values for various target markets without modifying overall wall thickness. Walls 10 can also be cost-performance optimized for specific applications. Use of this technique reduces the required curing related dwell time of the panel 10 in the moveable dam thereby speeding the manufacturing process. Other features could be incorporated into the panel 10 through the design of special extruded rigid foam insulation to manage sound attenuation.

As an alternate technique, when using a homogenous foam 18, smaller loose pieces of cured foam could simultaneously be blown into the void with the sprayed-in foam 18 to adapt the process to various shapes and to reduce labor.

Figure 2:
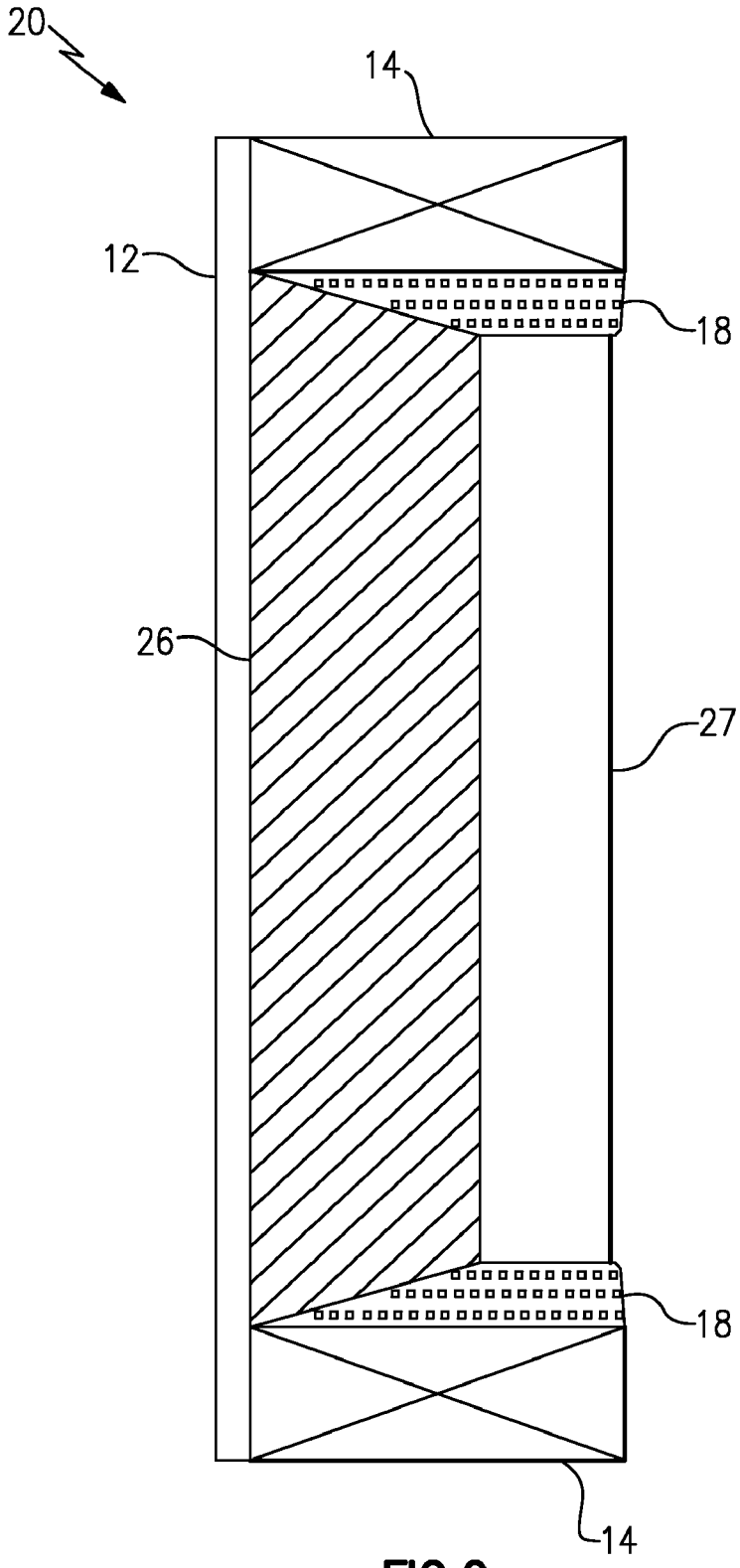
FIG. 2 illustrates a cavity cell of a second example insulated panel of the present invention in a top view cross section.

FIG. 2 is a top view cross section through a cavity cell of a prefabricated insulated panel 20 according to another embodiment of the present invention. Generally, the panel 20 includes the exterior sheathing 12 secured to the plurality of studs 14.

Between the studs 14, rigid foam panels 26 are secured to the exterior sheathing 12 and/or the studs 14. Preferably, the rigid foam panels 26 occupy more than half the width of the studs 14. For example, for nominal 2×4 studs 14, the rigid foam panels 26 could be at least two inches thick. The rigid foam panels 26 may be Expanded Polystyrene (EPS) or extruded polystyrene; however other materials may be used. The rigid foam panels 26 also have beveled sides adjacent the studs 14.

Second rigid foam panels 27 are then placed against the rigid foam panels 26. The second rigid foam panels 27 may be a polyurethane foam board; however other materials may be used.

The remaining space between the studs 14, rigid foam panels 26 and second rigid foam panels 27 is then filled with spray-pour foam 18, such as spray-pour polyurethane foam. For example, the remainder of the void can be filled with the spray-pour foam 18 by spraying the uncured spray-pour foam 18 into the void and letting the foam 18 cure in the void. Excess cured spray-pour foam 18 (for example, to the extent the cured foam 18 expands beyond the studs 14) is removed. Other methods for filling the void with foam could also be used. The rigid foam panels 14, 26 may be restrained or pressed against the sheathing 12 while the spray-pour foam 18 is filled and until it is at least substantially cured.

With this technique, the panel 20 is easier and less expensive to manufacture and is less subject to distortion caused by the curing of the foam. The rigid foam panels 26 displace sufficient foam 18 to eliminate distortion on the sheathing 12, while the spray-pour foam 18 still provides an air-tight seal between the studs 14. The beveled sides of the rigid foam panels 26 work as a guide in fitting the rigid foam panels 26 against the sheathing 12, as well as preventing the foam 18 from penetrating and expanding behind the rigid foam panels 26 and pushing them out of the cavity. The beveled sides of the rigid foam panels 26 also allow for the rigid foam panels 26 to be cut out and fit around electrical boxes or other such elements while still maintaining the desired airtight seal.

The rigid foam panels 26 can be less expensive and can have less insulating properties than the second rigid foam panels 27 and the spray-pour foam 18. This provides a well-insulated, cost-effective panel 20.

This technique also allows the mixing of different foam types in the spray-pour foam 18 to achieve different thermal resistance values for various target markets without modifying overall panel thickness. Panels 20 can also be cost-performance optimized for specific applications. Use of this technique reduces the required time for curing of the panel 20 thereby speeding the manufacturing process. Other features could be incorporated into the panel 20 through the design of special extruded rigid foam insulation to manage sound attenuation.

As an alternate technique, when using a homogenous foam 18, smaller loose pieces of cured foam could simultaneously be blown into the void with the sprayed-in foam 18 to adapt the process to various shapes and to reduce labor.

Figure 3:
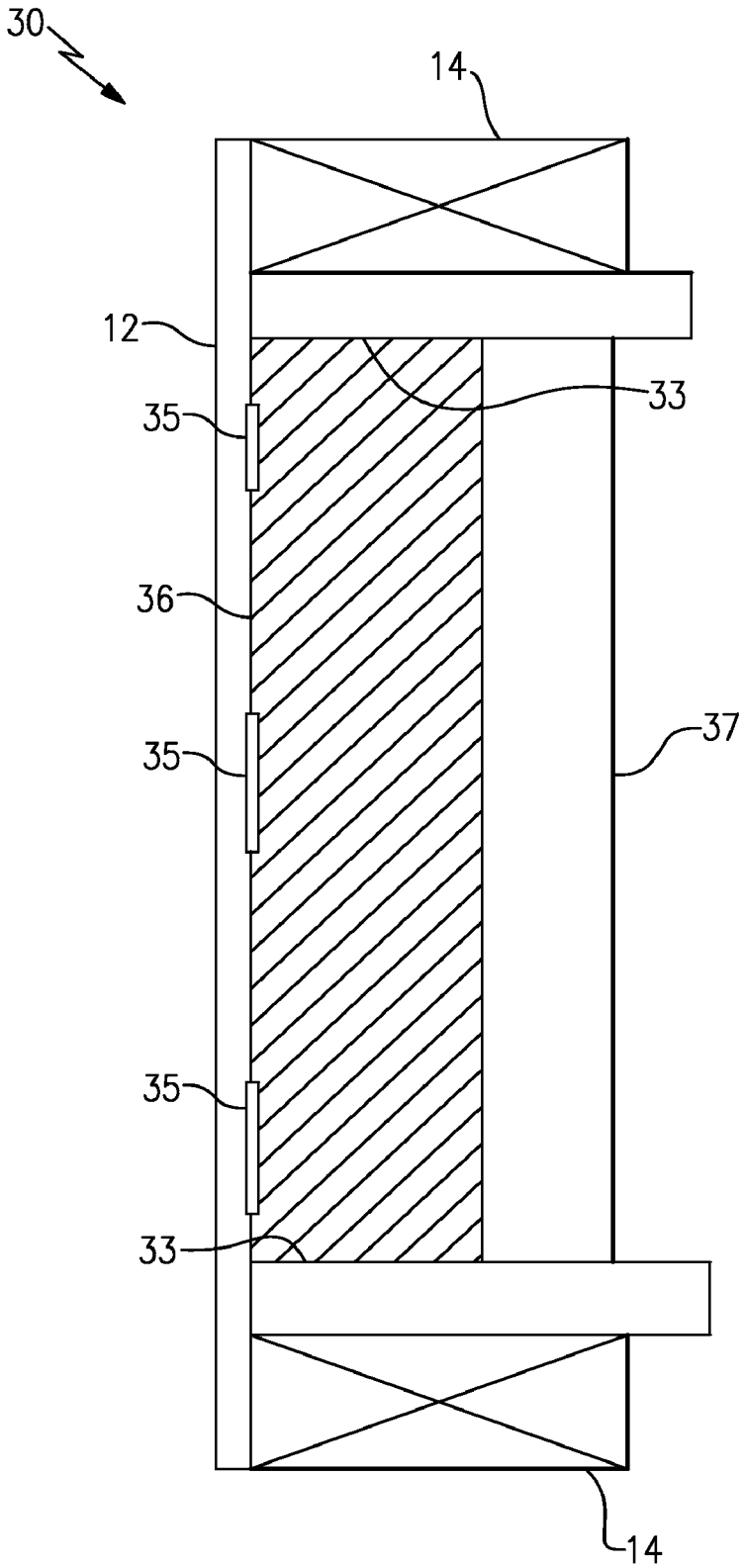
FIG. 3 illustrates a cavity cell of a third example insulated panel of the present invention during insertion of rigid panels in a top view cross section.

FIG. 3 is a top view cross section through a cavity cell of a prefabricated insulated panel 30 according to another embodiment of the present invention, during insertion of rigid panels. The panel 30 includes the exterior sheathing 12 secured to the plurality of studs 14.

Adhesive 35 is applied to the interior surface of the exterior sheathing and/or the exterior surface of the rigid foam panels 36. Guides 33, or spacers, are placed adjacent the studs 14 to properly position the rigid foam panels 36 as they are placed against the sheathing 12. The rigid foam panels 36 may then be secured using the adhesive 35 to prevent them from moving out of place during assembly. Preferably, the rigid foam panels 36 occupy more than half the width of the studs 14. For example, for nominal 2×4 studs 14, the rigid foam panels 36 could be at least two inches thick. The rigid foam panels 36 may be Expanded Polystyrene (EPS) or extruded polystyrene; however other materials may be used.

Second rigid foam panels 37 are then placed against the rigid foam panels 36, again using the guides 33 (spacers) for proper position. The second rigid foam panels 37 may be a polyurethane foam board; however other materials may be used. The second rigid foam panels 37 may be secured to the rigid foam panels 36 by adhesive (not shown).

When the adhesive 35 has at least partially set and the rigid foam panels 36, 37 are secured in place, the guides 33 are removed. In the example the guides 33 are pictured as pieces of dimensional lumber sized to fit the application; while this represents one method for guiding into and keeping in place the rigid foam panels 36 during assembly, other methods may be used.

Figure 4:
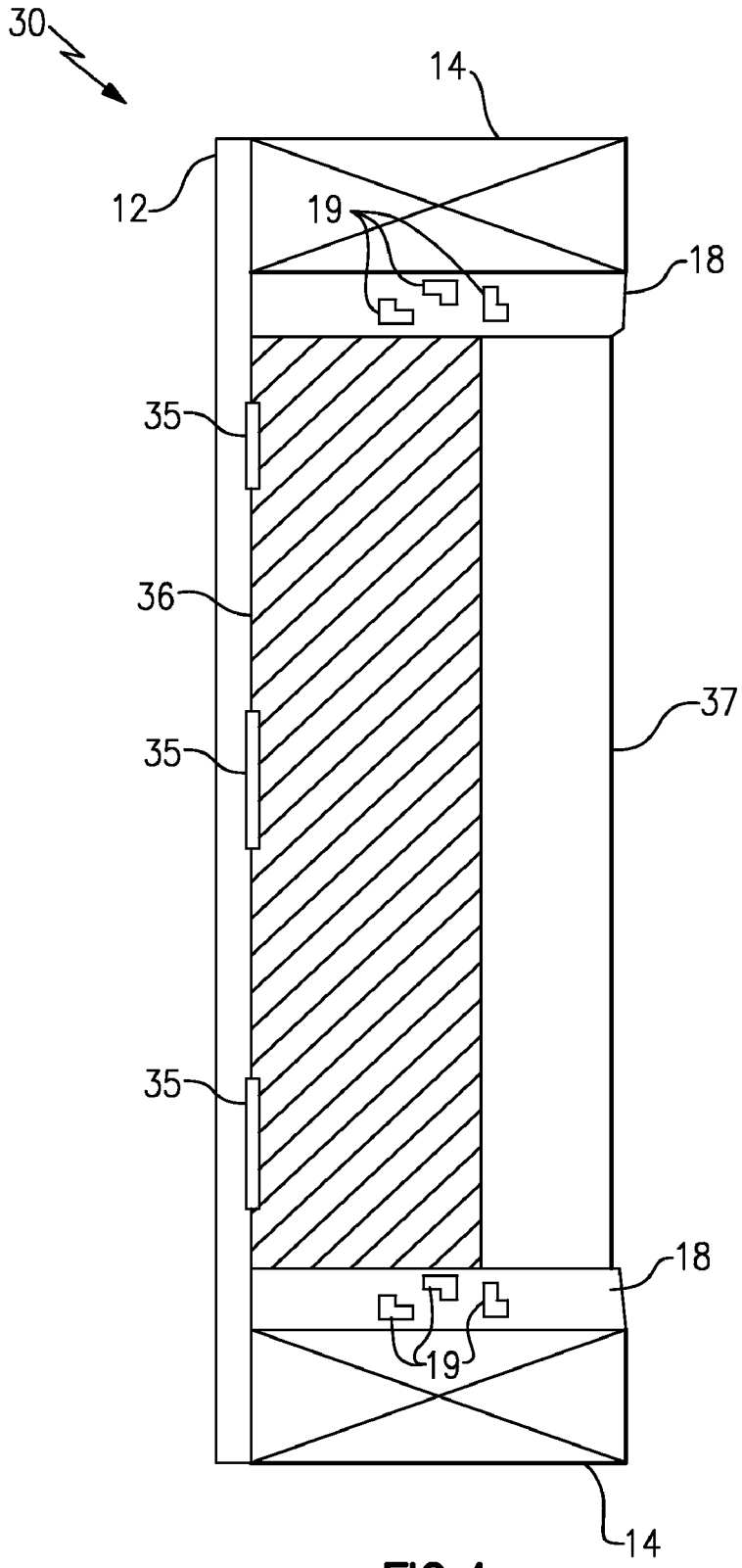
FIG. 4 illustrates the cavity cell of FIG. 3 after insertion of rigid panels and placement of the spray-pour foam in a top view cross section.

As shown in FIG. 4, after the rigid foam panels 36, 37 have been secured in place and the guides 33 removed, the remaining space between the studs 14, rigid foam panels 36 and second rigid foam panels 37 is then filled with the spray-pour foam 18, such as spray-pour polyurethane foam. For example, the remainder of the void can be filled by spraying the spray-pour foam 18 into the void and letting it cure in the void. Any excess foam 18 is then removed. Other methods for filling the void with foam could also be used. The rigid foam panels 36, 37 may be restrained or pressed against the sheathing 12 while the spray-pour foam 18 is filled and until it is at least substantially cured.

With this technique, the panel 30 is easier and less expensive to manufacture and is less subject to distortion caused by the curing of the foam. The rigid foam panels 36 displace sufficient foam 18 to eliminate distortion on the sheathing 12, while the spray-pour foam 18 still provides an air-tight seal between the studs 14. The second rigid foam panels 37 increase the insulating properties of the panel 30. The rigid foam panels 36 are without beveled sides, which further eases manufacture. The rigid foam panels 36 can quickly be cut to size and fitted to a particular cavity. The rigid foam panels 36 can still be fitted around electrical boxes or other such elements.

This technique also allows the mixing of different foam types in the spray-pour foam 18 to achieve different thermal resistance values for various target markets without modifying overall panel thickness. Panels 30 can also be cost-performance optimized for specific applications. Use of this technique reduces the required curing related dwell time of the panel 30 thereby speeding the manufacturing process. Other features could be incorporated into the panel 30 through the design of special extruded rigid foam insulation to manage sound attenuation. The rigid foam panels 36 can be less expensive and can have less insulating properties than the second rigid foam panels 37 and the spray-pour foam 18. This provides a well-insulated, cost-effective panel 30.

As an optional technique shown for example in FIG. 4, when using a homogenous foam 18, smaller loose pieces of cured foam 19 could simultaneously be blown into the void with the sprayed-in foam 18 to adapt the process to various shapes and to reduce labor.

Figure 5:
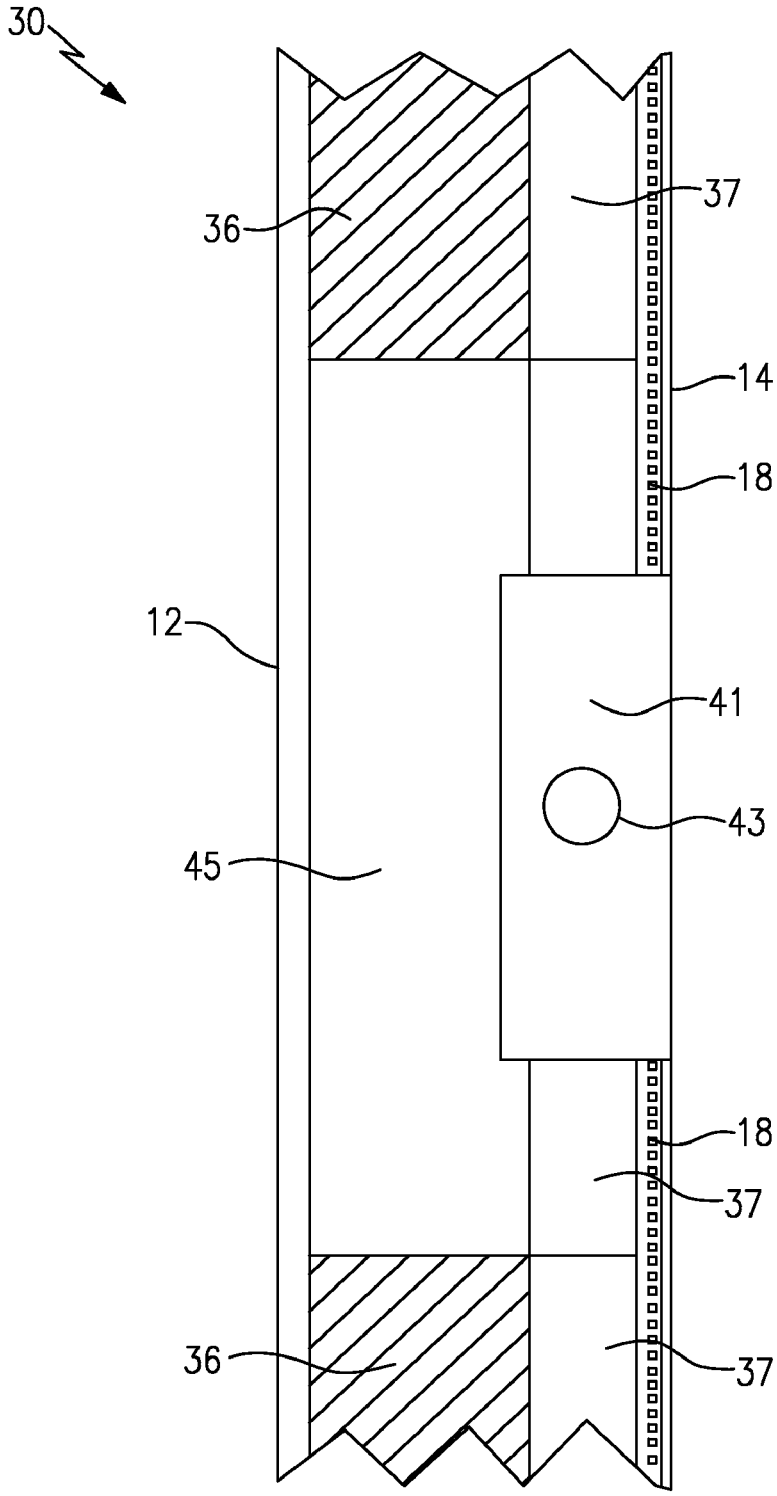
FIG. 5 is a section view of a cavity cell of the present invention with adjustments made for an electrical box in a side view cross section.

FIG. 5 is a side view cross section through the panel 30 of FIG. 4, with the section taken generally parallel to the studs 14, and showing an optional modification for accommodating an electrical box 41 and conduit 43 (or other channels or cut-outs in the panel 30).

Generally, the panel 30 is as shown in FIG. 4, with the rigid foam panels 36 against the sheathing 12 and the second rigid foam panels 37 exterior of the rigid foam panels 36. However, optionally, in areas where there is conduit 43 and/or electrical boxes 41 or other channels or cutouts, a third rigid foam panel 45 is placed against the exterior sheathing 12 instead of the rigid foam panel 36.

As is shown, the center area accommodates the electrical box 41 and an electrical conduit 43. To make up for the loss of insulation material cut away from the second rigid foam panel 37 to accommodate the electrical box 41 and electrical conduit 43, the third rigid foam panel 45 may be used instead of the rigid foam panel 36. The third rigid foam panel 45 may be of a different material than that of the rigid foam panels 36, and preferably the third rigid foam panel 45 would be have higher insulating properties than the rigid foam panel 36 to compensate for the loss of insulating material from second rigid foam panel 37. For example, the third rigid foam panel 45 can be of the same material as the second rigid foam panel 37 (for example, polyurethane foam board); however other materials may be used.

For all of the above embodiments, another benefit should be noted. In applications where a vapor barrier would be required, if the polyurethane layer (cured in-place foam and/or rigid foam board) is at least two inches thick across the entire panel, it may not be necessary to add a vapor barrier (depending upon the application and/or the relevant building codes in the applicable jurisdiction). This provides some additional cost saving.

As used herein, the term "rigid" when referring to the "rigid foam board" is used to mean that the foam is at least substantially cured and has a substantially defined shape, in contrast to spray-pour foam which is shaped and cured after being placed into the panel. As should be apparent, in the figures, the distance between the studs 14 is not to scale.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A method for fabricating an insulated foam panel comprising the steps of:

(a) inserting a first rigid foam panel against sheathing between studs;

(b) placing a second rigid foam panel against the first rigid foam panel, such that the first rigid foam panel is between the second rigid foam panel and the sheathing;

(c) after said step (a), placing uncured foam between the first rigid foam panel and the studs and between the second rigid foam panel and the studs.

2. The method of claim 1, wherein the first rigid foam panel is expanded polystyrene.

3. The method of claim 2, wherein the second rigid foam panel is polyurethane.

4. The method of claim 3, wherein the uncured foam is a spray-pour polyurethane foam.

5. The method of claim 4, wherein the uncured foam includes pieces of pre-cured foam.

6. The method of claim 5, further including the steps of:

(d) placing spacers between the first rigid foam panel and the studs;

(e) securing the first rigid foam panel to the sheathing after said step (d) and after said step (a).

7. The method of claim 6 further including the step of removing the spacers before said step (c).

* * * * *